US008961379B2

(12) United States Patent
Flentye et al.

(10) Patent No.: US 8,961,379 B2
(45) Date of Patent: Feb. 24, 2015

(54) ELONGATE MEMBER FOR FORMING AN EXERCISE DEVICE

(75) Inventors: Herbert T. Flentye, Glenview, IL (US); Gregory Niederlander, Gurnee, IL (US)

(73) Assignee: SPRI Products, Inc., Libertyville, IL (US)

( * ) Notice: Subject to any disclaimer, the term of this patent is extended or adjusted under 35 U.S.C. 154(b) by 140 days.

(21) Appl. No.: 13/610,549

(22) Filed: Sep. 11, 2012

(65) Prior Publication Data

US 2014/0051555 A1 Feb. 20, 2014

Related U.S. Application Data

(63) Continuation-in-part of application No. 13/585,597, filed on Aug. 14, 2012, now Pat. No. 8,876,678.

(51) Int. Cl.
*A63B 21/02* (2006.01)
*A63B 71/00* (2006.01)

(52) U.S. Cl.
USPC ..... 482/139; 482/121; 482/126

(58) Field of Classification Search
USPC ..... 482/139, 92, 91, 148, 81, 82, 121–126
See application file for complete search history.

(56) References Cited

U.S. PATENT DOCUMENTS

| | | | | |
|---|---|---|---|---|
| 113,384 | A | 4/1871 | Barnett | |
| 232,579 | A | 9/1880 | Weeks | |
| 652,617 | A | 6/1900 | Hotz | |
| 2,930,614 | A | 3/1960 | McIntosh | |
| 3,427,023 | A | 2/1969 | Silberman | |
| 4,756,527 | A | 7/1988 | Ledbetter | |
| 5,431,617 | A | 7/1995 | Rattray, Jr. | |
| 5,505,677 | A | 4/1996 | Hinds | |
| 5,800,322 | A | 9/1998 | Block | |
| 6,497,641 | B1 | 12/2002 | Hinds | |
| 6,676,576 | B1 | 1/2004 | Wu | |
| 6,923,750 | B1 | 8/2005 | Hinds | |
| 7,147,592 | B2 | 12/2006 | Hinds | |
| 7,316,636 | B1 | 1/2008 | Hinds | |
| 7,326,157 | B2 * | 2/2008 | Wu | 482/126 |
| 7,344,485 | B1 | 3/2008 | Simpson | |
| 7,357,762 | B1 | 4/2008 | Terry | |
| 7,377,886 | B2 | 5/2008 | Wu | |
| 7,448,990 | B2 | 11/2008 | Wu | |
| 7,455,632 | B2 | 11/2008 | Block et al. | |
| 7,503,883 | B2 * | 3/2009 | Madden | 482/126 |
| 7,578,775 | B2 | 8/2009 | Terry | |
| 7,625,324 | B1 | 12/2009 | Hinds | |
| 7,628,743 | B1 * | 12/2009 | Flentye et al. | 482/126 |
| 7,641,604 | B2 | 1/2010 | Blount | |
| D650,873 | S | 12/2011 | Terry | |

(Continued)

*Primary Examiner* — Loan H Thanh
*Assistant Examiner* — Megan Anderson
(74) *Attorney, Agent, or Firm* — Barnes & Thornburg LLP

(57) ABSTRACT

An exercise device comprising at least one elastic tube, a connector engaged with the elastic tube, an enlarged element, a webbing interconnecting the enlarged element and the connector; and a handle comprising a yoke and a handgrip. The yoke defining at least one passage sized to receive the webbing and to prevent the passage therethrough of the enlarged element to releasably secure the handle to the elongate member. The elongate member may comprise a plurality of elastic tubes braided together. Each of the elastic tubes may have an enlarged end for engaging the connector. The exercise device further including a sheath disposed over the webbing extending between the connector and the enlarged element. Said one passage sized to receive the sheath and the webbing.

13 Claims, 14 Drawing Sheets

(56) References Cited

U.S. PATENT DOCUMENTS

| | | | | |
|---|---|---|---|---|
| 8,075,461 | B2 | 12/2011 | Terry | |
| 8,075,462 | B1 | 12/2011 | Hinds | |
| 8,152,703 | B1 | 4/2012 | Hinds | |
| 8,348,814 | B1 | 1/2013 | Hinds et al. | |
| 8,480,549 | B1 * | 7/2013 | Hinds et al. | 482/143 |
| 8,491,446 | B2 * | 7/2013 | Hinds et al. | 482/8 |
| 8,657,727 | B1 * | 2/2014 | Kassel et al. | 482/122 |
| 2005/0075223 | A1 | 4/2005 | Wu | |
| 2005/0137066 | A1 * | 6/2005 | Wu | 482/126 |
| 2006/0105893 | A1 | 5/2006 | Chen | |
| 2007/0155600 | A1 | 7/2007 | Cunningham et al. | |
| 2008/0300117 | A1 * | 12/2008 | Madden | 482/126 |
| 2009/0176634 | A1 * | 7/2009 | Wu | 482/122 |
| 2011/0237410 | A1 | 9/2011 | Perez | |
| 2012/0302406 | A1 * | 11/2012 | Hinds et al. | 482/8 |
| 2013/0288864 | A1 | 10/2013 | Holland | |

* cited by examiner

ELONGATE MEMBER FOR FORMING AN EXERCISE DEVICE

CROSS REFERENCE TO RELATED APPLICATIONS

This application is a continuation-in-part of U.S. patent application Ser. No. 13/585,597 titled "Exercise Device and Handle for Same" and filed Aug. 14, 2012.

The present disclosure relates generally to an exercise device that is detachably attached to a structure.

BACKGROUND

Resistance exercise devices comprising a stretchable elastic tube and a pair of handles are known. An example of a resistance exercise device including a stretchable elongate tube is disclosed, for example, in U.S. Pat. No. 5,800,322. Such exercise devices typically are available in tubes of different resistances. The resistance level is based upon the resistance level of the tube.

SUMMARY

The present disclosure is directed to an exercise device comprising an elastic tube or other elongate member, a connector engaged with the elastic tube, an enlarged element, a webbing interconnecting the enlarged element and the connector, and a handle comprising a yoke and a handgrip. The yoke includes a base defining at least one passage sized to receive the webbing and to prevent the passage therethrough of the enlarged element to releasably secure the handle to the elongate member. The elongate member may comprise a plurality of elastic tubes that are braided together. Each of the elastic tubes may have an enlarged end for engaging the connector. The connecter may define a plurality of holes, each hole sized receiving a respective one of the braided tubes. Each hole may also be sized to prevent passage therethrough of a respective enlarged end. The exercise device may further include a sheath disposed over a portion of the webbing extending between the connector and the enlarged element, wherein the passage is sized to receive the sheath and the portion of the webbing.

The yoke may further define an other passage extending through the base and a channel extending through the base interconnecting the passages. The other passage is sized to permit the passage therethrough of the webbing and the enlarged element to selectively engage and disengage the elongate member and the handle. The channel is sized to permit movement of the webbing from the other passage to the passage to releasably secure the enlarged element to the yoke.

The present disclosure is also directed to a means for releasably securing the elastic tube or other elongate member to the handle of the exercise device described above.

Features and advantages of the disclosure will be set forth in part in the description which follows and the accompanying drawings described below, wherein embodiments of the disclosure is described and shown, and in part will become apparent upon examination of the following detailed description taken in conjunction with the accompanying drawings.

DETAILED DESCRIPTION

Figure 1:
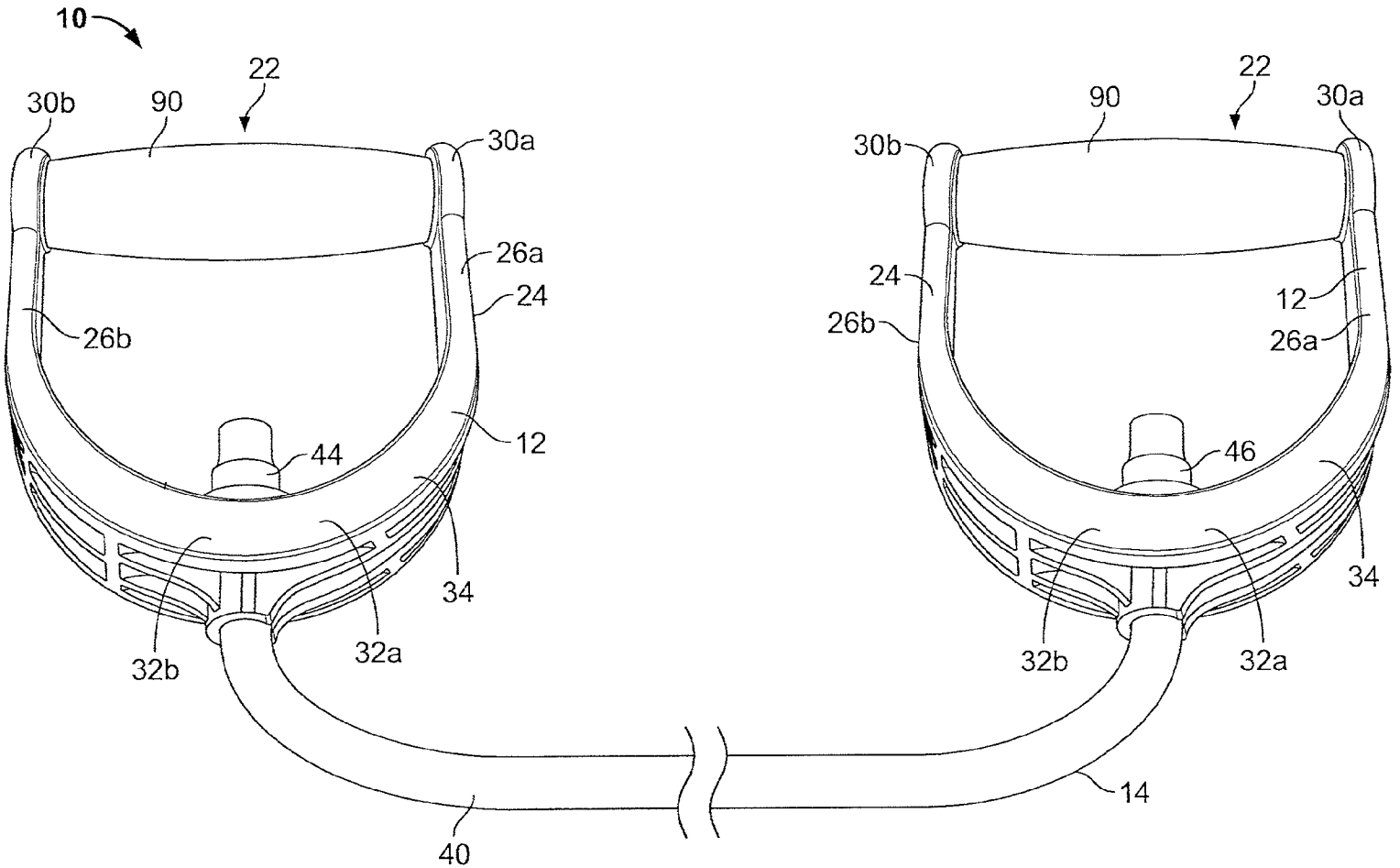
FIG. 1 is a front elevational view of an exercise device in accordance with an illustrated embodiment of the present disclosure having two handles, an elongate member and a pair of enlarged elements associated with the ends of the elongate member.
Figure 2:
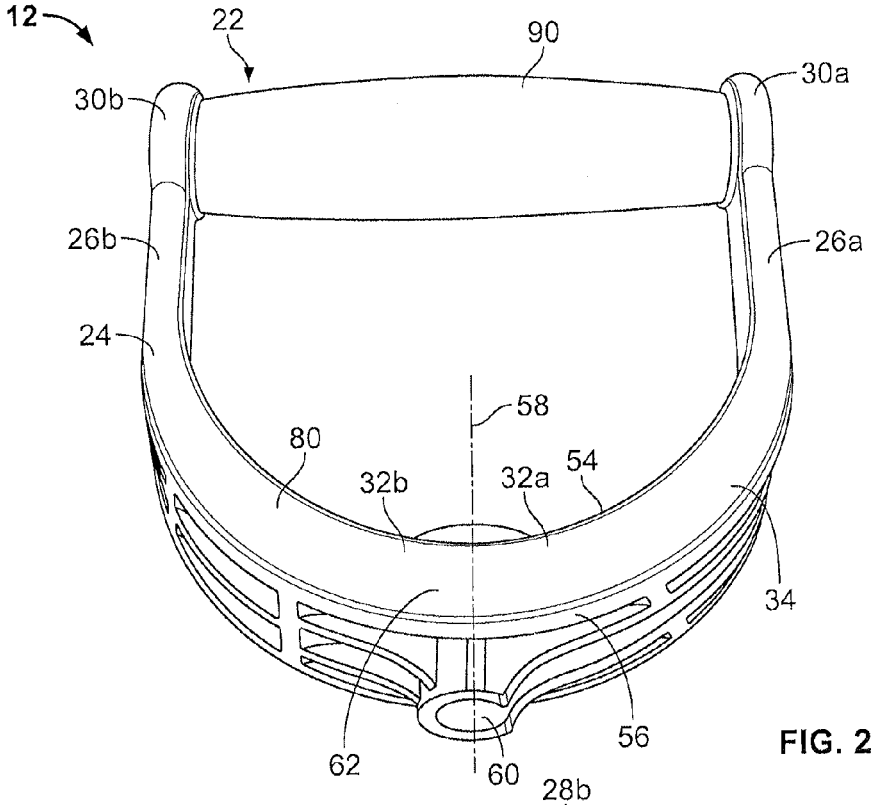
FIG. 2 is a bottom perspective view of the handle of the exercise device of FIG. 1.

While the present disclosure may be embodied in many different forms, several specific embodiments are discussed herein with the understanding that the present disclosure is to be considered only as an exemplification of the principles of the disclosure, and it is not intended to limit the disclosure to the embodiments illustrated.

FIGS. 1-9 depict an illustrated embodiment of an exercise device 10 comprising a handle 12 and an elongate member 14. The handle 12 generally includes a handgrip 22 and a yoke 24 extending outwardly from the handgrip 22 and generally having a U-shape. The yoke 24 includes first and second arms 26*a*, 26*b* having apertures 28*a*, 28*b* through first ends 30*a*, 30*b* of the arms 26*a*, 26*b*, respectively. The apertures 28*a*, 28*b* are in communication with the handgrip 22, as described hereinafter. Second ends 32*a*, 32*b* of the arms 26*a*, 26*b* curve inwardly and are integrally connected to form the yoke 24. The yoke 24 includes a base 34 interconnecting the arms 26*a*, 26*b*. While the yoke 24 is shown and described as being U-shaped, the yoke 24 may take other shapes in accordance with other embodiments of the present disclosure. The handle 12 may have other constructions and configurations in accordance with other embodiments of the present disclosure.

The elongate member 14 may be in the form of a stretchable or otherwise elastic tube 40 having a pair of ends, each end releasably securable to one of the handles 12. The illustrated elastic tube 40 has a dimension in the form of diameter D1 and first and second enlarged elements in the form of enlarged ends 44, 46 having a dimension in the form of diameter D2. The diameter D1 is less than the diameter D2. The enlarged ends 44, 46 are enlarged elements to releasably secure the elastic tube 40 to the handle 14.

While the elastic tube 40 and enlarged ends 44, 46 are shown as having a generally circular cross-section and having diameters, the elastic tube 40 and/or enlarged ends 44, 46 may have different cross-sections, for example, a square-shaped, hexagonal, pentagonal, or other cross-sectional. The elongate member 14 may be constructed of any other resilient material or other material and have any other suitable dimensions and configuration in accordance with other embodiments of the present disclosure. In the illustrated embodiment, the enlarged ends 44, 46 are formed by insertion of cylindrical elements within the channel defined by the elongate member. The enlarged ends 44, 46 may be associated with the elastic tube 40 as disclosed above or in any other suitable manner. The enlarged ends may be formed by any other suitable means and also may be in the form of any other type of enlarged element formed in any suitable manner anywhere along the length of the elongate member 14 that engages the handle 12.

Figure 3:
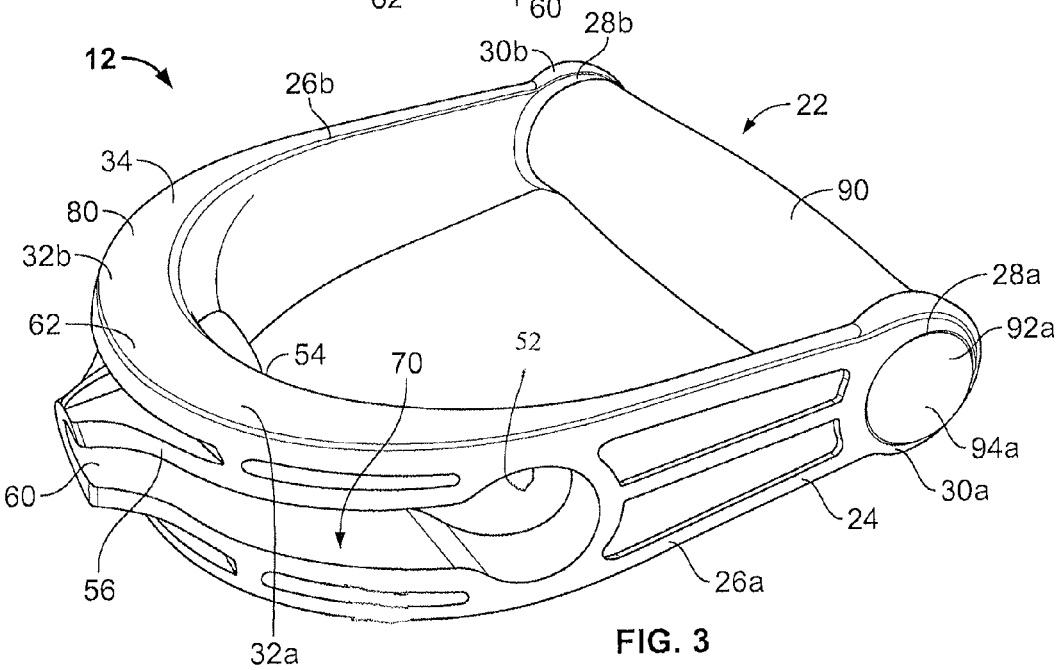
FIG. 3 is a side perspective view of the handle of FIG. 2.
Figure 4:
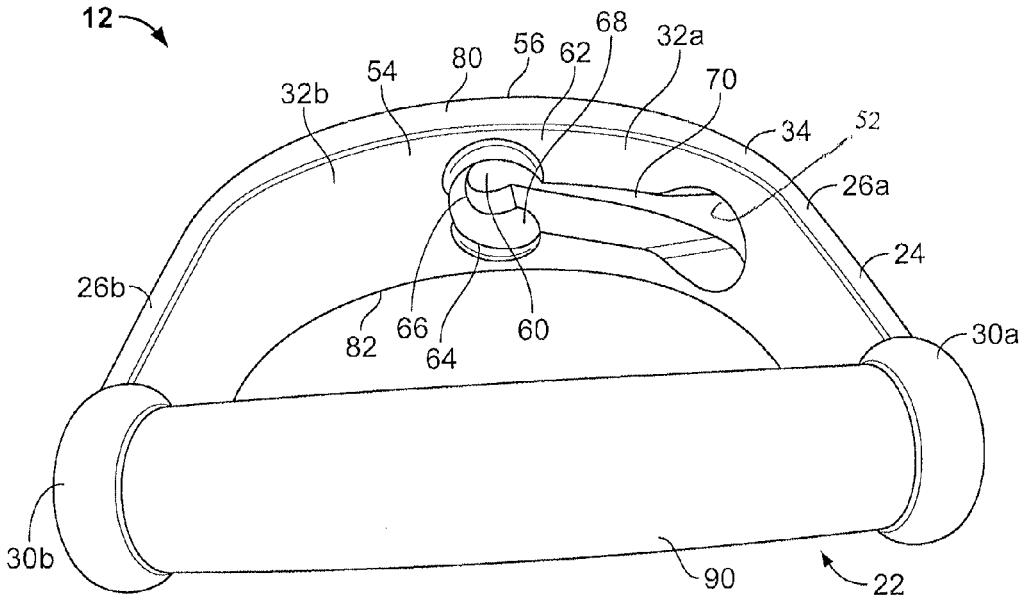
FIG. 4 is a top perspective view of the handle of FIG. 2.
Figure 5:
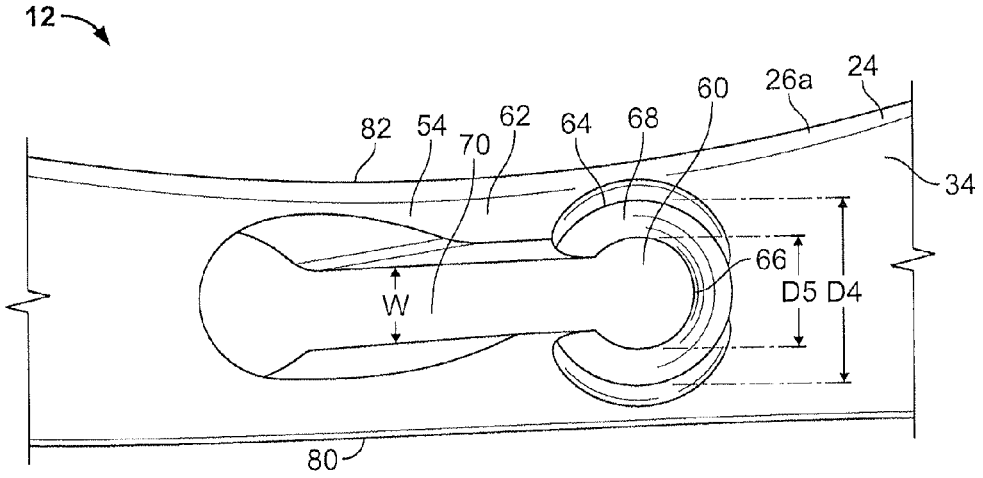
FIG. 5 is a partial top plan elevational view of the handle of FIG. 2.

With reference to FIGS. 3-5, the base 34 of the yoke 24 defines a first passage 52 disposed within the first arm 26*a* and extending between first and second opposing surfaces 54, 56 of the yoke 24. The first passage 52 extends through the base 34. The first passage 52 has a clearance dimension in the form of diameter D3. The diameter D3 is greater than the diameter D1 of the elastic tube 40 and the diameter D2 of the enlarged ends 44, 46. A second passage 60 is defined by a center 62 of the yoke 24 between the first and second arms 26*a*, 26*b*. The second passage 60 also extends between the first and second opposing surfaces 54, 56 of the base 34, and extends through the base 34.

Referring to FIGS. 3 and 4, the second passage 60 includes an upper section 64 in the form of a bore having a dimension in the form of diameter D4 and a lower section 66 in the form of a hole contiguous with the bore having a clearance dimension in the form of diameter D5. The diameter D5 is less than the diameter D4, thereby creating a ledge 68 between the upper and lower sections 64, 66. The diameter D4 is greater than the diameter D2 of the enlarged ends 44, 46 of the elongate member 14 and the diameter D5 is less than the diameter D2 of the enlarged ends 44, 46 of the elongate member 14. The second passage 60 has a longitudinal axis 58 that generally bisects the handle 12. In this manner, when the elongate member 14 is attached to the yoke 24 and a user grips and pulls on the handgrip 22, the elongate member 14 is generally coincident with the longitudinal axis 58 of the second passage 60, as will be discussed in greater detail hereinafter.

Figure 6:
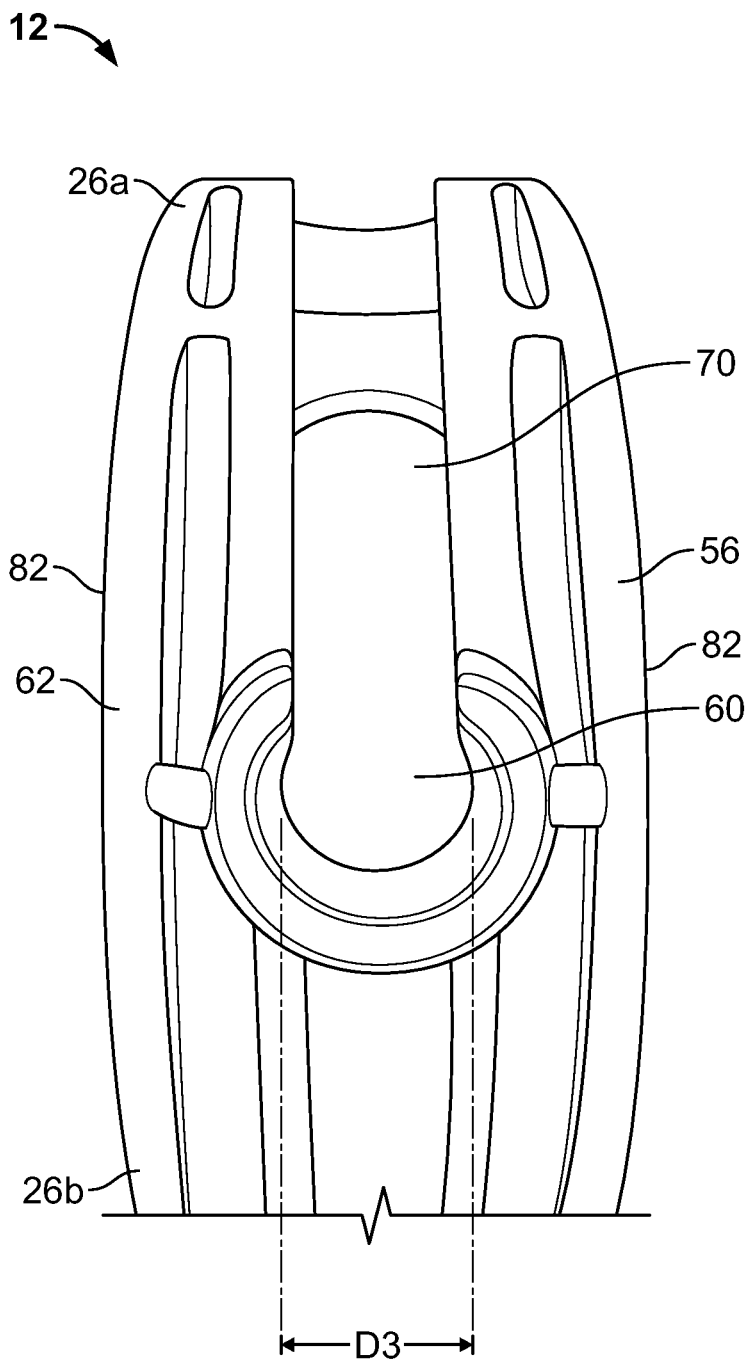
FIG. 6 is a bottom plan view of the handle of FIG. 2.

With reference to FIGS. 4-6, a channel 70 extends between the first and second opposing surfaces 54, 56 of the yoke 24 and interconnects the first and second passages 52, 60. The channel 70 extends through the base 34. Each of the first and second passages 52 and 60 is illustrated as being generally cylindrical and as being in communication with the channel 70. The channel 70 has a clearance dimension in the form of a width W that is greater than the diameter D1 of the elastic tube, but less than the diameter D2 of the enlarged ends 44, 46 of the elongate member 14. The passages 52, 60 may be of any suitable cross-sectional shape, for example, cylindrical, square-shaped, hexagonal, pentagonal, or any other cross-sectional shape. In such an embodiment, the passages 52, 60 may have different forms of clearance dimensions. The first passage 52, the second passage 60, and the channel 70 interconnecting the first and second passages 52, 60 extend through the yoke 24 between the first and second opposing surfaces 54, 56, but do not extend to front and rear opposing surfaces 80, 82 of the yoke 24.

The first passage 52 is sized to permit the passage therethrough of the elongate member 14 and one of the enlarged ends 44, 46. The second passage 60 is sized to permit the passage therethrough of the elastic tube 40 and to prevent the passage therethrough of the enlarged end 44 or 46. The channel 70 is sized to permit passage therethrough of the elongate member 14 and to prevent passage through the channel of the enlarged end so that the elongate member can be moved from the first passage 52 to the second passage 60.

Figure 7A:
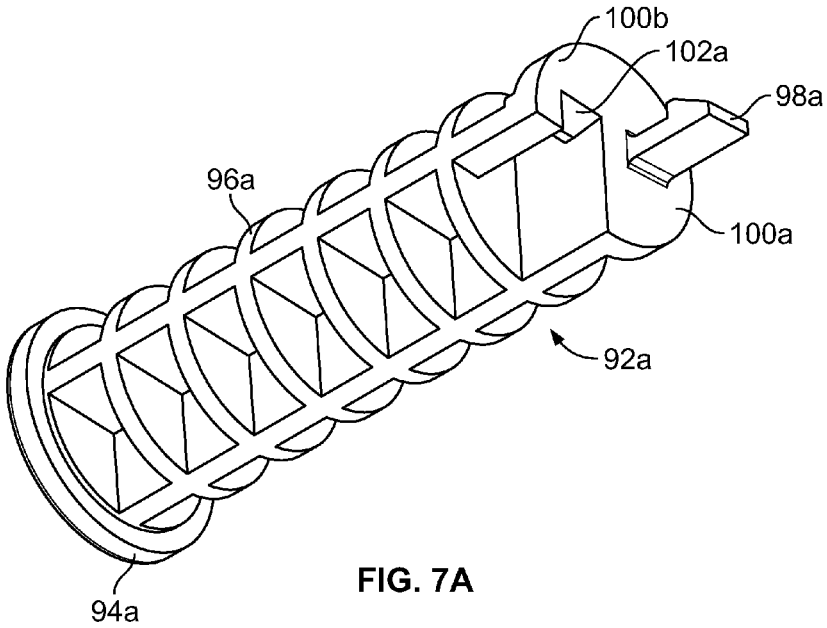
FIG. 7A is a perspective view of a first core member of a handgrip of the handle of FIG. 2.
Figure 7B:
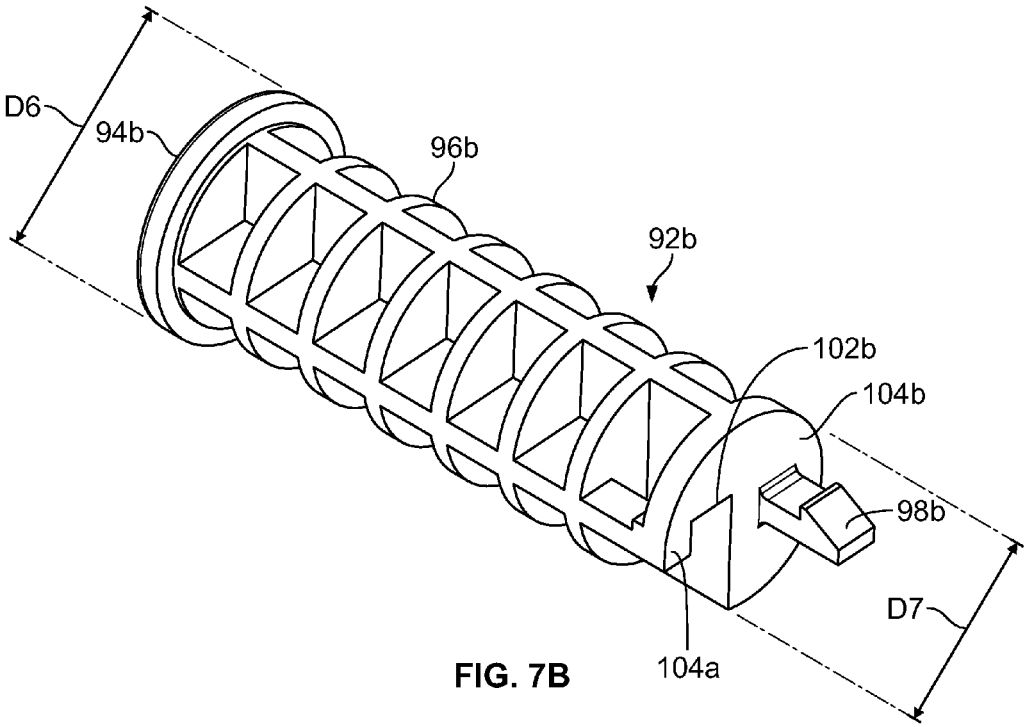
FIG. 7B is a perspective view of a second core member of the handgrip of the handle of FIG. 2.
Figure 7C:
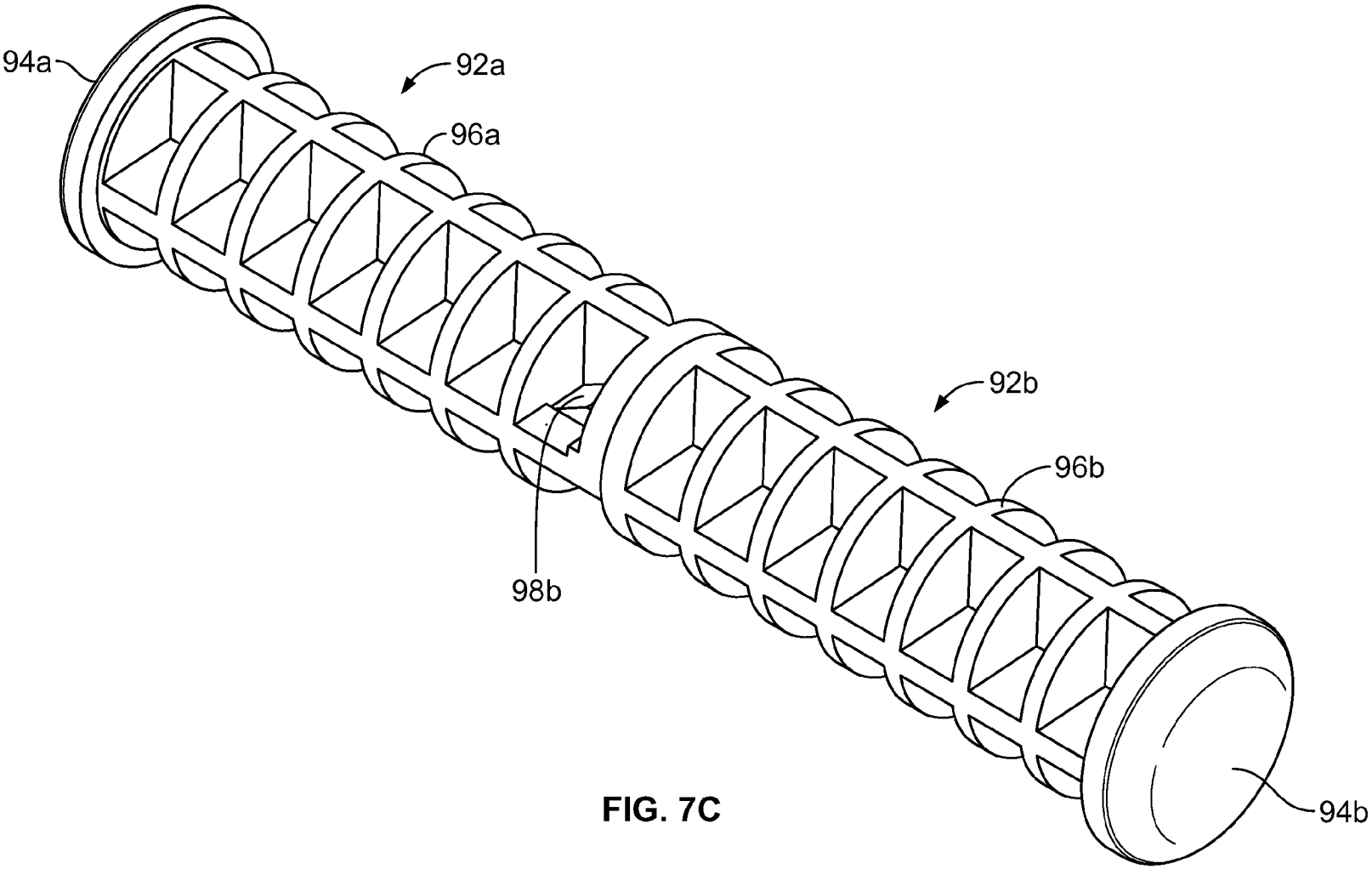
FIG. 7C is a perspective view of the first and second core members seen in FIGS. 7A and 7B, wherein the core members are attached to one another.
Figure 8:
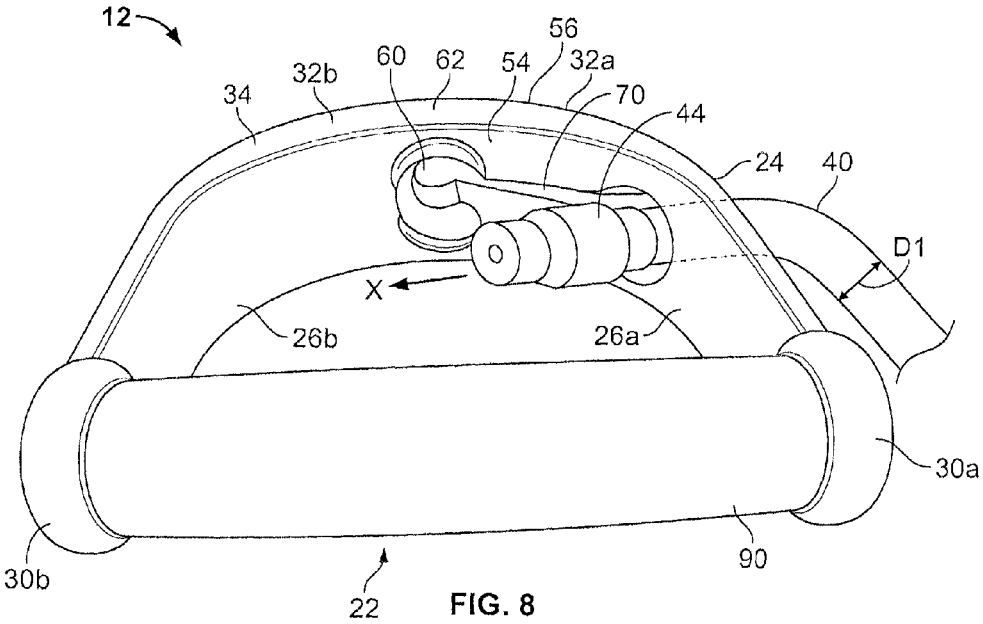
FIG. 8 is a top perspective view of the handle of FIG. 2 illustrating one of the enlarged elements and the elongate member received by a passage defined by the handle.
Figure 9:
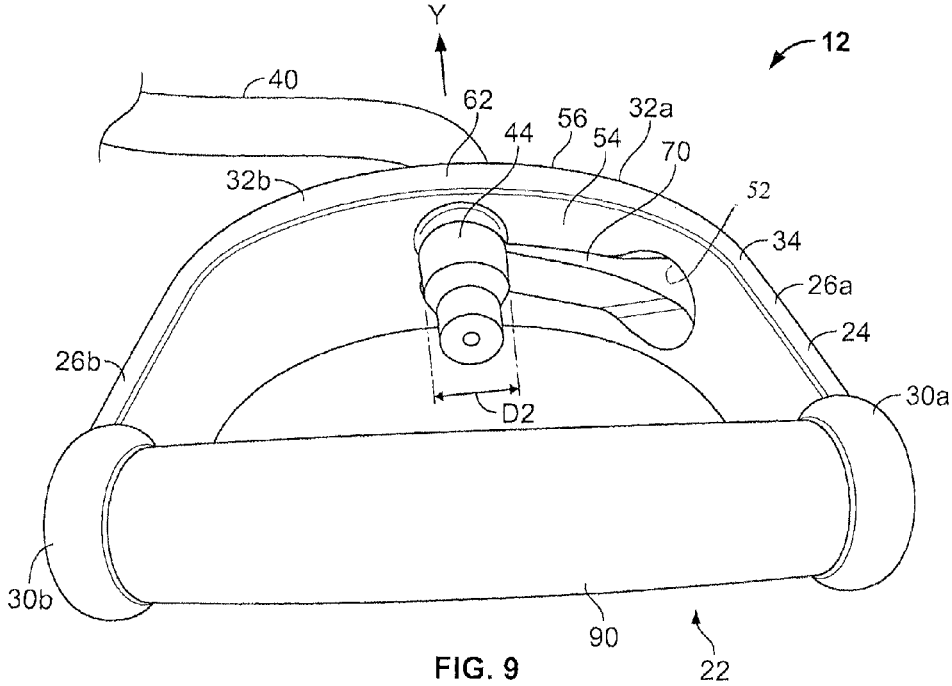
FIG. 9 is a top perspective view of the handle and the enlarged element of FIG. 8 illustrating the enlarged element and the elongate member disposed within an other passage defined by the handle after the elongate member has been moved along the channel into the other passage.

Referring to FIGS. 4 and 7A-7C, the handgrip 22 includes a hollow cylindrical tube 90 and first and second core members 92*a*, 92*b* extending through the apertures 28*a*, 28*b* in the arms 26*a*, 26*b* and connected within the cylindrical tube 90 to form the handgrip 22. The first and second core members 92*a*, 92*b* include first and second end caps 94*a*, 94*b* having a dimension in the form of diameter D6 and first and second supports 96*a*, 96*b* extending outwardly from the first and second end caps 94*a*, 94*b*, respectively, and having a generally cylindrical profile and having a dimension in the form of diameter D7 less than the diameter D6 of the end caps 94*a*, 94*b*. As seen in FIG. 7A, the first core member 92*a* further includes an upwardly extending hook member 98*a* extending outwardly from a first side 100*a* of the first support 96*a* and a downwardly facing groove 102*a* on a second side 100*b* of the support 96*a*. As seen in FIG. 7B, the second core member 92*b* includes a downwardly facing groove 102*b* on a first side 104*a* of the second support 96*b* and an upwardly extending hook member 98*b* extending outwardly from a second side 104*b* of the second support 96*b*.

The handgrip 22 is assembled by inserting the core members 92*a*, 92*b* through the apertures 28*a*, 28*b* in the arms 26*a*, 26*b*, respectively. The core members 92*a*, 92*b* are aligned such that the upwardly extending hook member 98*a* of the first support 96*a* is aligned with the downwardly facing groove 102*b* of the second support 96*b* and the upwardly extending hook member 98*b* of the second support 96*b* is aligned with the downwardly facing groove 102*a* of the first support 96*a*. The hook members 98*a*, 98*b* ride up ramps associated with the opposing grooves 102*a*, 102*b* and into the grooves 102*a*, 102*b* to connect and retain the core members 92*a*, 92*b*. Once assembled, it is difficult to pull the core members 92*a*, 92*b* apart. In addition, the diameter D6 of the end caps 94*a*, 94*b* is greater than a diameter of the apertures

28*a*, 28*b*, such that the end caps 94*a*, 94*b* abut respective arms 26*a*, 26*b* surrounding the apertures 28*a*, 28*b*.

In operation, each handle 12 is engaged with the elongate member 14 by inserting a respective one of the enlarged ends 44, 46 of the elastic tube 40 into the first passage 52 in a first direction X until the enlarged end 44 passes fully through the first passage 52 and the elastic tube 40 is within the first passage. The user then slides the elastic tube 40 along the channel 70 until the elastic tube 40 is disposed in the second passage 60. Once in the second passage 60, the elastic tube 40 is pulled in a second direction Y that is coincident with the longitudinal axis 58 of the second passage 60. Due to the diameter D2 of the enlarged end 44 (or 46) being less than the diameter D4 of the upper section 64 of the second passage 60 and being greater than the diameter D5 of the lower cylindrical section 66 of the second passage 60, the enlarged end 44 is pulled into the upper section 64. The enlarged end 44 of the elastic tube 40 is seated on the ledge 68, thereby retaining the enlarged end 44 within the second passage 60. This process may be repeated to attach the second handle 12 to the other enlarged end 46 (or 44), as depicted in FIG. 1.

In the illustrated embodiment, dimension W of channel 70 is greater than the diameter D1 of the elastic tube 40. In accordance with other embodiments, the dimension W may be less than the diameter D1 of the elastic tube 40 in which event the elastic tube 40 may be pulled or otherwise stretched to fit within the channel 70 as it is moved to the second passage 60.

Once the handle 12 is secured to the elastic tube 40, the exercise device 10 may be used in any suitable manner. For example, the handle 12 may be used by gripping the handgrips 22 with one's hands or feet and performing exercises. A user may manually grasp one or both handles and perform exercise or may use their feet to engage one or more handles or step on a portion of the elastic tube 40 and move the handles 12 to perform exercises. Other exercises may include attaching the elastic tube 40 or one or both handles 14 to a structure and performing exercises.

As seen in FIGS. 10-15, in accordance with other embodiments of the present disclosure, the handle 12 may instead be used with an elongate member 106 in the form of a cord formed of multiple elastic tubes 108 that are braided. The exercise device 10 illustrated in FIGS. 10-15 also includes means for releasably securing the elongate member 106 to the handle 12.

In the illustrated embodiments, the tubes 108 are engaged with a connector 109. Each of the tubes 108 includes a bulbous end 110 that is releasably engaged with the connector 109, which defines four holes receiving the respective tubes and four bores receivingly engaging the respective bulbous ends 110. Each bore is continuous with and coaxial to a respective hole. Each hole is sized to receive a receptive tube 108 and to prevent the respective bulbous end 110 from passing therethrough. Each bore is sized to receive a respective one of the bulbous ends 110 to releasably engage or otherwise secure the bulbous end and the handle 12.

The connector 109 includes first and second opposing sides 112*a*, 112*b* having first and second channels 114*a*, 114*b* formed through the sides 112*a*, 112*b*, respectively. The connector 109 may have any other suitable construction and configuration in accordance with other embodiments of the present disclosure.

A first end 116 of an inelastic webbing 118 is looped through the first channel 114*a* and attached to itself in any suitable manner, for example, by sewing. The webbing 118 further extends through an enlarged portion in the form of an enlarged element 120 such that a central section 122 of the webbing 118 is disposed through the enlarged element 120. A second end 124 of the webbing 118 extends through the second channel 114*b* and is attached to itself in any manner known in the art. While channels 114*a*, 114*b* are shown for attachment of the webbing 118 and the connector 109, any other means for attaching the webbing 118 to the connector 109 may alternatively or additionally be used. The webbing 118 may be made of nylon or any other suitable material. In addition, while the webbing 118 is shown as being flat, the webbing 118 need not be flat and may have any shape.

Figure 10:
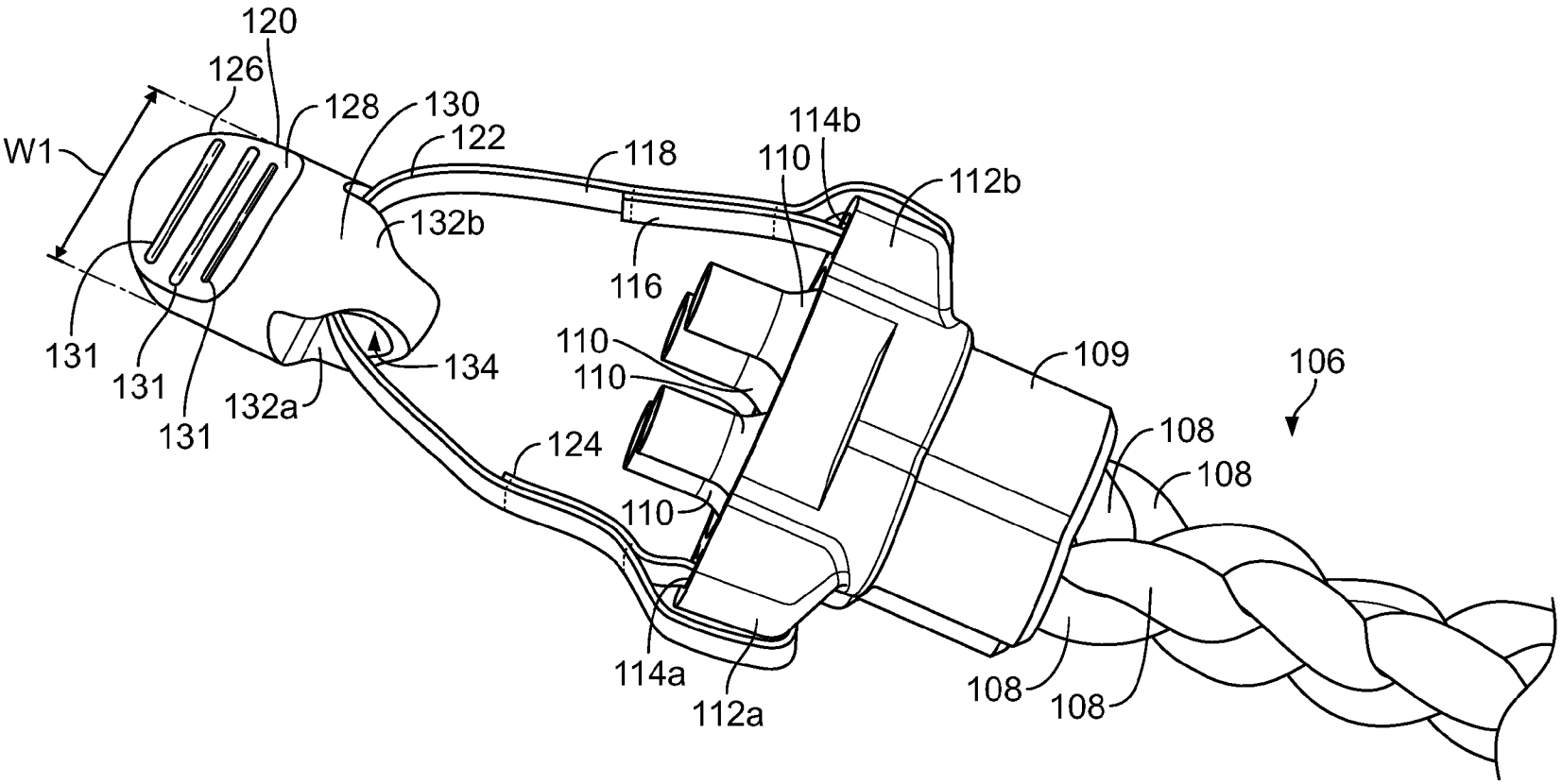
FIG. 10 is a partial perspective view of an exercise device in accordance with an other embodiment, illustrating the elongate member in the form of braided elastic tubes, and a connector, a webbing and an enlarged element for releasably securing the elongate member to one of the handles of the exercise device.
Figure 11:
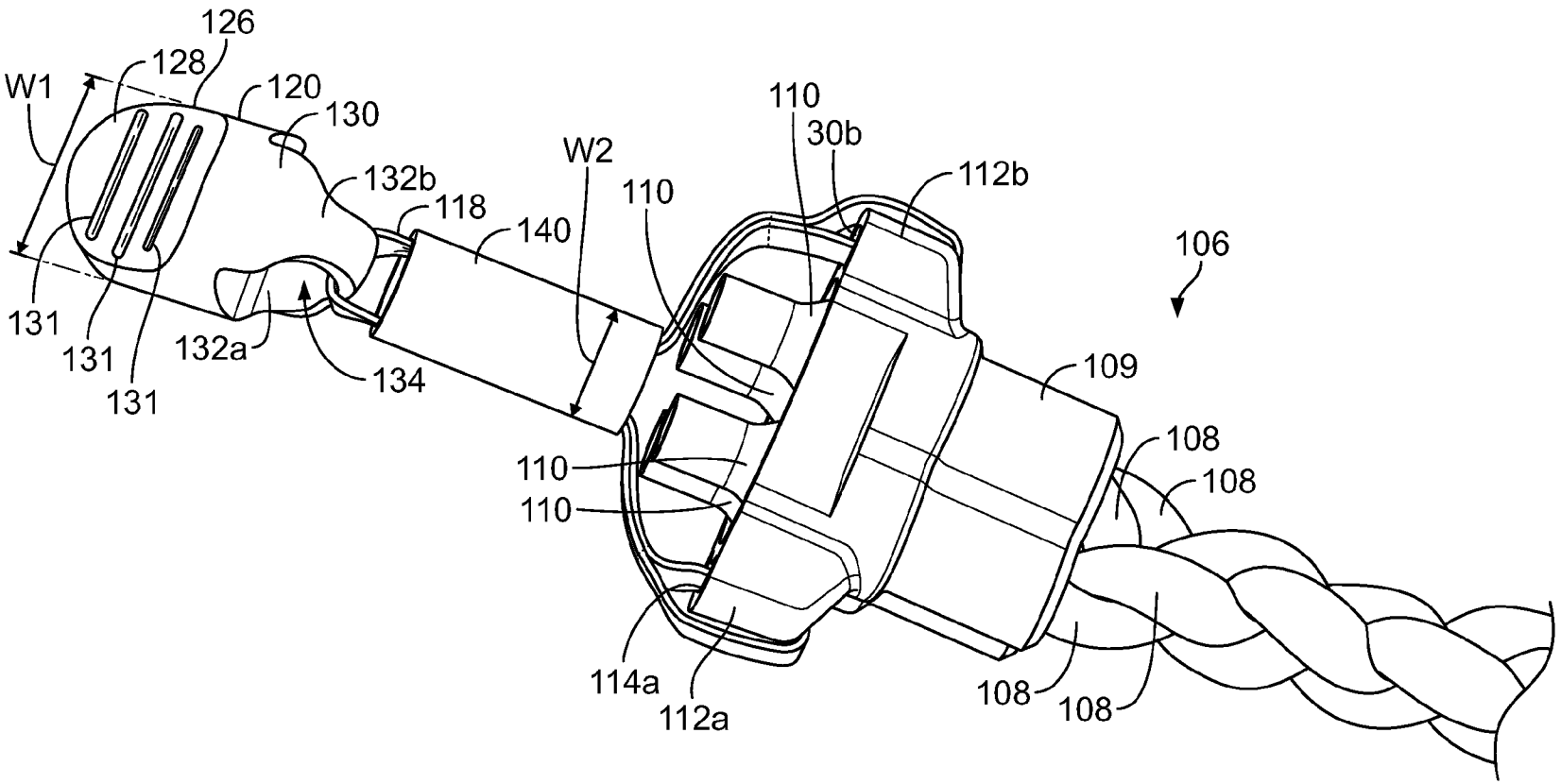
FIG. 11 is a partial perspective view of the exercise device of FIG. 10 further including a sheath disposed over a portion of the webbing.
Figure 12:
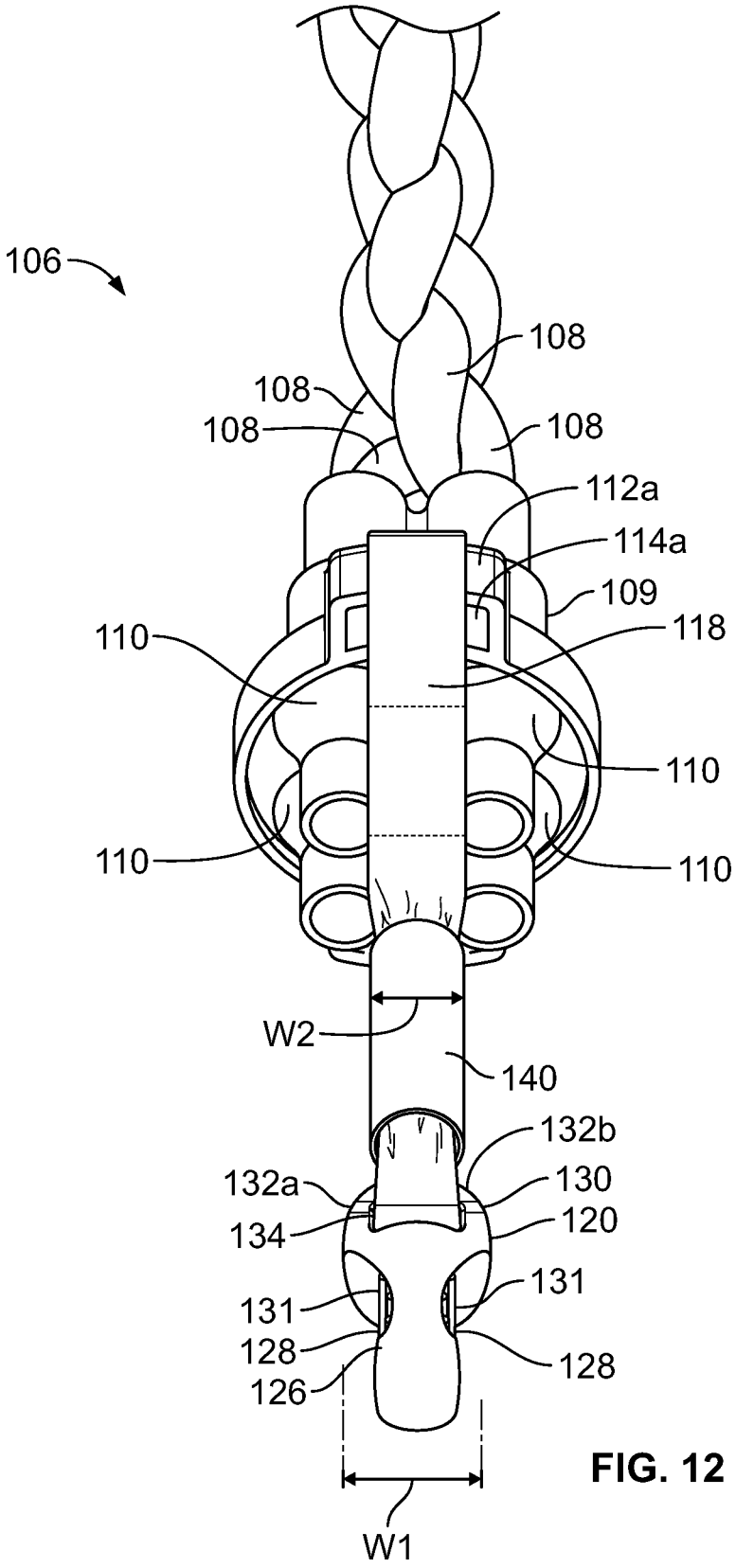
FIG. 12 is another partial perspective view of the exercise device shown in FIG. 11.

With reference to FIGS. 10-12, the enlarged element 120 includes a gripping portion 126 with opposing curved surfaces 128 having gripping ribs 131. The gripping portion 126 is shaped such that a user may grasp the opposing curved surfaces 128 to pull or otherwise move the elongate member 106. The enlarged element 120 further includes a plug portion 130 extending downwardly from the gripping portion 126 and including two arms 132*a*, 132*b* that extend downwardly and inwardly to form a channel 134 through the plug portion 130. The plug portion 130 has a width W1. As can be seen in FIGS. 10-12, the overall shape of the plug portion 130 may rounded or spherical such that the plug portion 130 may be seated against a rounded or spherical surface, as will be discussed below. Alternatively, the plug portion 130 may have any shape that conforms or does not conform to a surface against which it is seated. The enlarged element 120 may have any other suitable construction and configuration in accordance with other embodiments.

Figure 13:
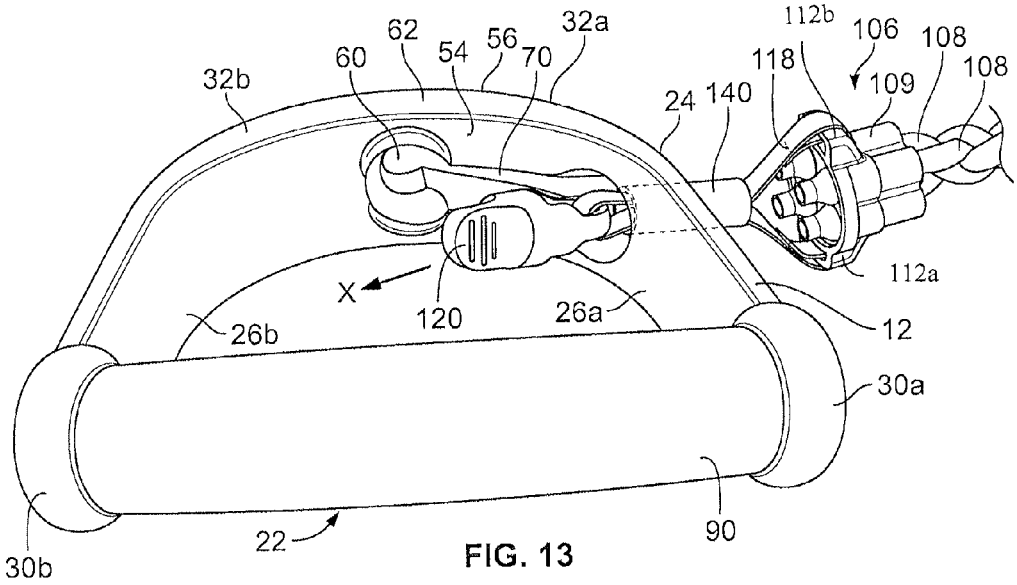
FIG. 13 is another partial perspective view of the exercise device of FIG. 11, illustrating the enlarged element, the webbing and the sheath received by one of the passages defined by the handle.
Figure 14:
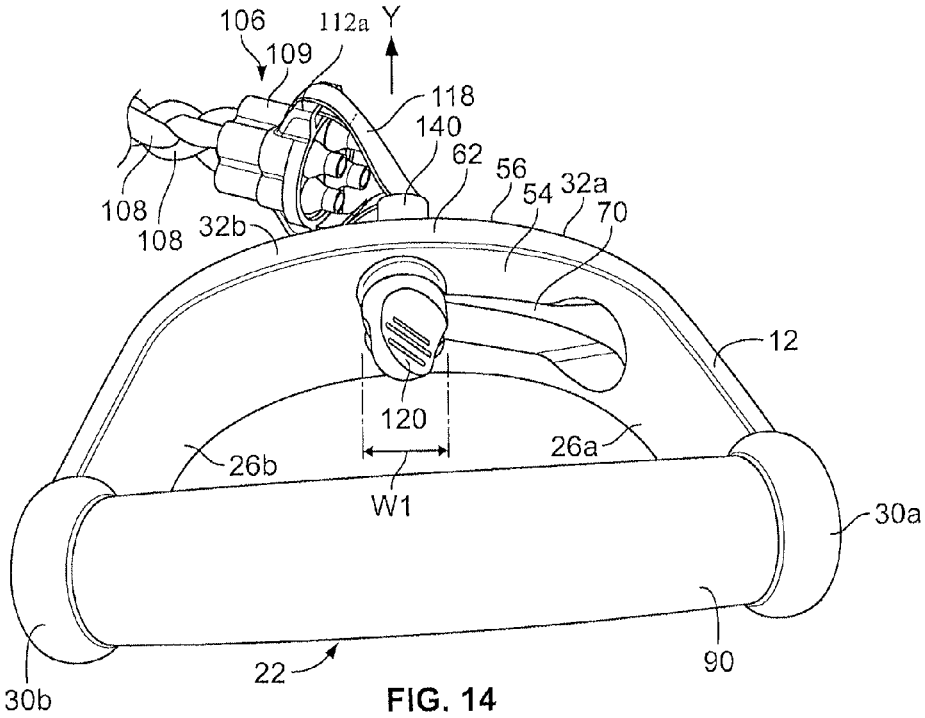
FIG. 14 is a partial perspective view of the exercise device of FIG. 11, illustrating the enlarged element, the webbing and the shank received by the other passage of the handle after the webbing and sheath has been moved from the one passage along the channel to the other passage and the enlarged element releasably secured to the handle.

With reference to FIGS. 13 and 14, a sheath in the form of a hollow tubular member 140 may be disposed over the webbing 118 between the connector 109 and the enlarged element 120. The tubular member 140 squeezes the webbing 118 to reduce its lateral width. In particular, the tubular member 140 condenses the webbing 118 into an area having a width or clearance dimension of about W2 or less. The tubular member 140 may have any other suitable construction and configuration in accordance with other embodiments of the present disclosure.

Figure 15:
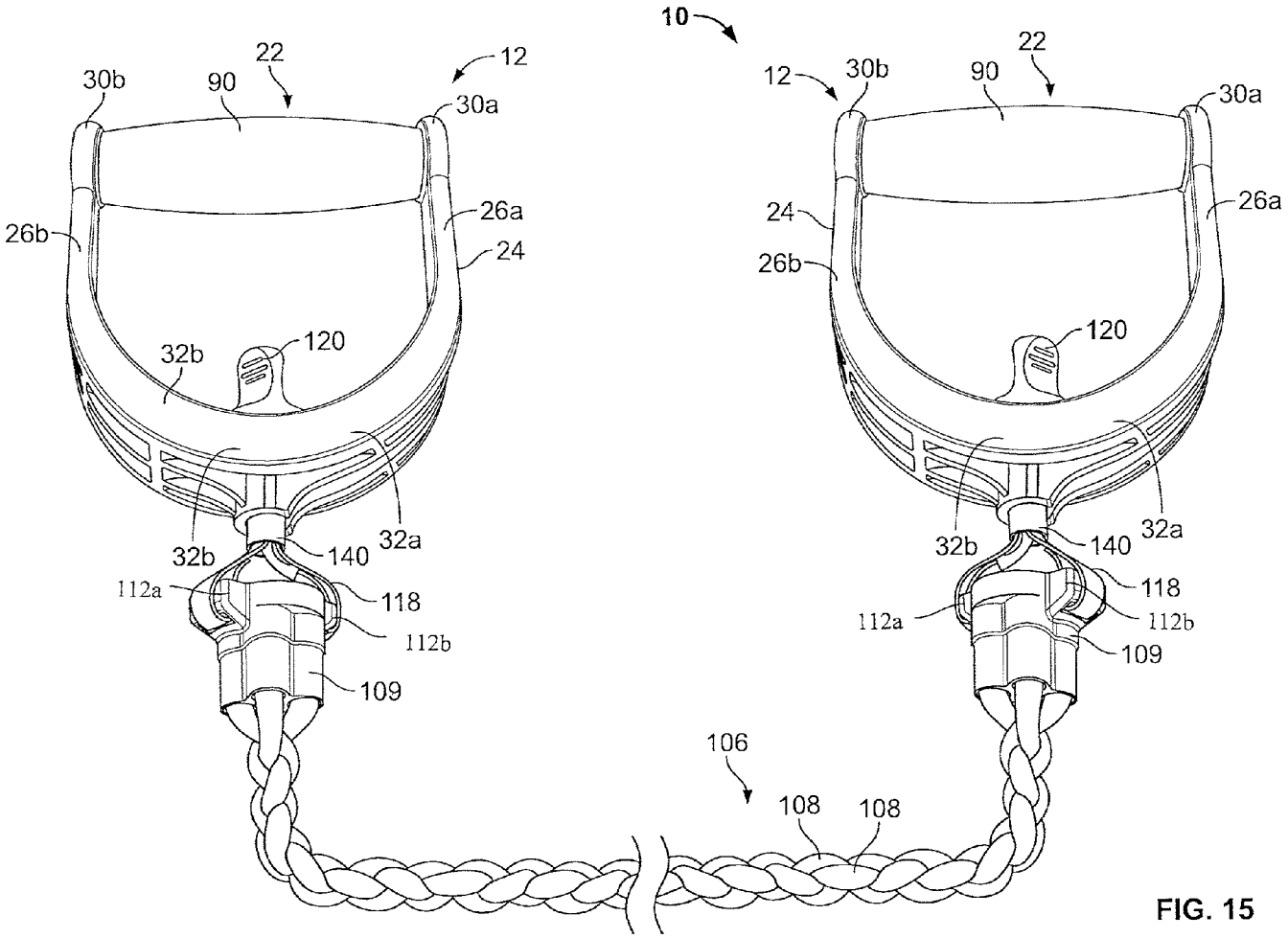
FIG. 15 is a partial perspective view of the exercise device of FIG. 11, illustrating the elongate member releasably secured to the handles.

The webbing 118, the tubular member 140 and the enlarged element 120 are receivable by the first passage 52 of the handle 12 to selectively engage and disengage the elastic tube 40 and the handle 12. To assemble the exercise device 10, the webbing 118, the tubular member 140 and the enlarged element 120 are engaged with the handle 12 by inserting the enlarged element 120, the webbing 118 and the tubular member 140 into the first passage 52 of the handle 12 in the first direction X until the enlarged element 120 passes fully through the first passage 52. The user then slides or otherwise moves the webbing 118 and the tubular member 140 along the channel 70 until the webbing 118 and the tubular member 140 is received by the second passage 60. The movement can be effected in any suitable manner such as, for example, by manually grasping the gripping portion 126. Once in the second passage 60, the enlarged element 120 is pulled in the second direction Y that is coincident with the longitudinal axis 58 of the second passage 60. The pulling can be effected in any suitable manner such as, for example, by manually grasping the elongate member 106. A width W1 or other clearance dimension of the enlarged element 120 is less than the diameter D4 of the upper section 64 of the second passage 60 and is greater than the diameter D5 of the lower cylindrical section 66 of the second passage 60. The enlarged element 120 is therefore pulled into the upper section 64 until the enlarged element 120 is seated and retained against the ledge 68. This process may be repeated to attach a second handle 12 to an opposite end of the elongate member 106, as depicted in FIG. 15. To disengage the elongate member 40 and the handle 12, the above process is reversed. When the exercise device 10 is assembled, the exercise device may be used by gripping the handgrips 22 with one's hands or feet and performing exercises in the same manner as described above.

Figure 16:
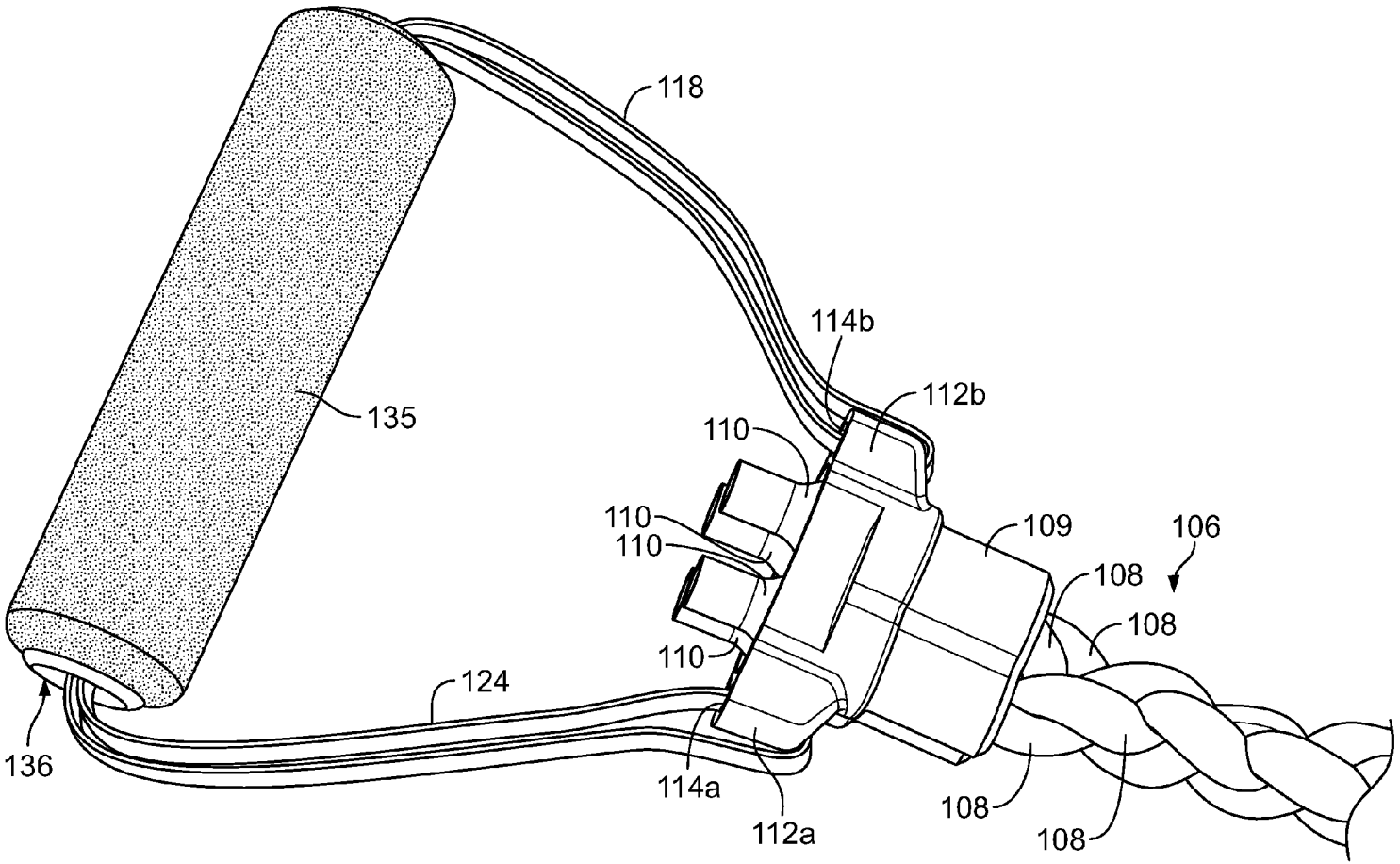
FIG. 16 is a partial perspective view of an other embodiment of the exercise device of the present disclosure, illustrating a handle including a handgrip and a strap securing the handgrip to the connector.

A further embodiment of the exercise device is depicted in FIG. 16. In this embodiment, the ends of the webbing 118 are sewn together (not shown) to create a strap that is doubled up. In addition, the enlarged element 120 has been removed and replaced with a handle 135 having a hollow core 136 through which the webbing 118 extends. While the embodiment of FIG. 16 is the only embodiment herein that is shown with webbing that is doubled up, any of the embodiments herein may include webbing that is doubled up.

Figure 17:
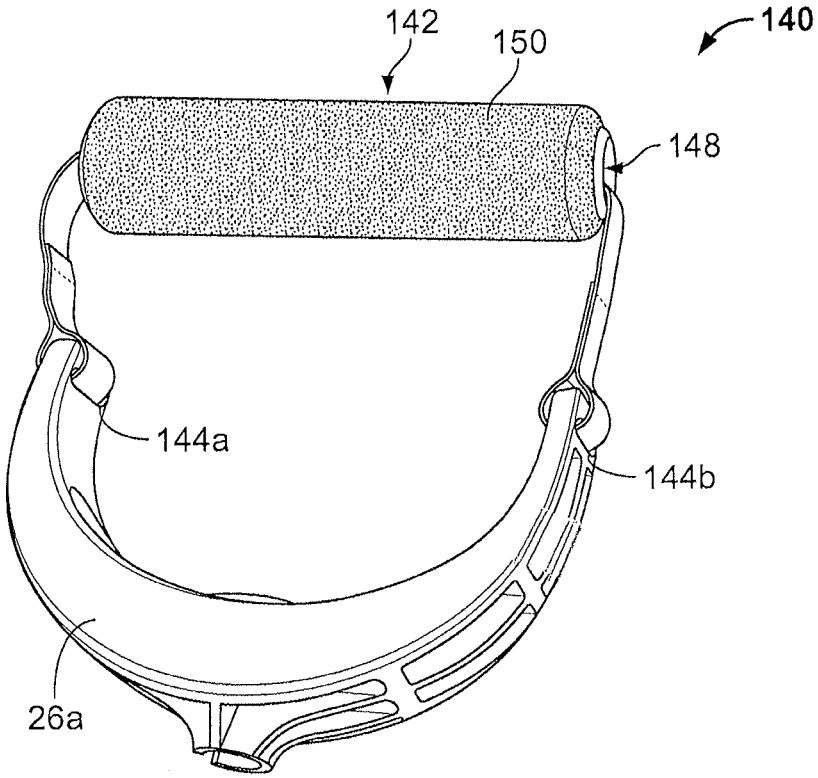
FIG. 17 is a perspective view of handle of an exercise device in accordance with an other embodiment of the present disclosure.
Figure 18:
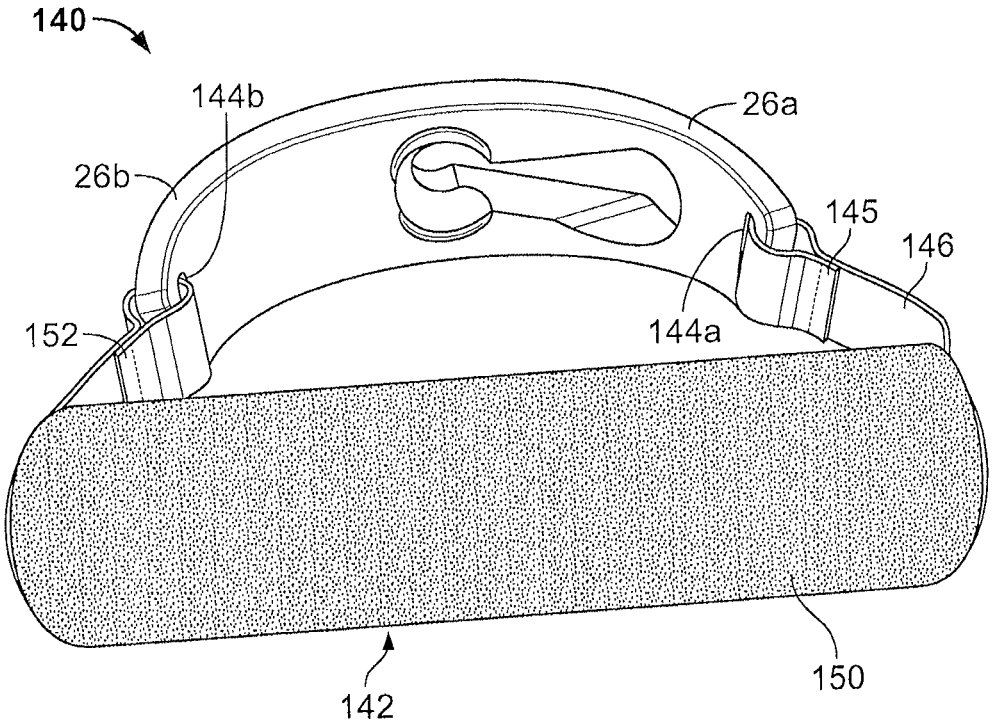
FIG. 18 is an other perspective view of the handle of FIG. 17.

A further embodiment of a handle 140 is depicted in FIGS. 17 and 18. In this embodiment, the handgrip 142 differs from the handgrip 22 described above. Features of the handle 140 similar to those of the handle 12 of the first embodiment are numbered similarly. The arms 26*a*, 26*b* of the yoke of the handle 12 are shorter and include elongated apertures 144*a*, 144*b*, respectively. A first end 145 of a strap 146 extends through the aperture 144*a* and is sewn to itself to connect the strap to the arm 26*a*. The strap 146 extends through a hollow core 148 of a padded grip 150 to form a handgrip and a second end 152 of the strap 146 extends through the aperture 144*b* and is sewn to itself to connect the strap to the arm 26*b*. The elongate member 14 or the elongate member 106 may be attached to the handle 140 in the same manner as disclosed with respect to the first embodiment and exercises are performed in the same manner. Optionally, as noted above, the first and second ends 145, 152 of the strap 146 may be sewn to each other so that the strap 146 is doubled up.

The dimensions in the form of each of diameters D1-D7 and W may have any other suitable configuration and shape and thus may or may not be in the form of diameters or widths. Further, the clearance dimensions described herein are intended to be the dimension in the passage of channel that limits the size of the structure that can pass therethrough regardless of the configuration of the clearance dimensions or the structure. For example, the clearance dimension of the first passage 52 may be sufficiently large to receive the enlarged end 44, 46, the clearance dimension of the second passage 60 may be sufficiently small to permit the enlarged end from passing therethrough, and the clearance dimension of channel 70 may be sufficiently small to permit the enlarged end from passing therethrough. Further, each of these clearance dimensions may be defined by any suitable structure of the base 34 that limits the size of the structure that can pass therethrough. For example, each clearance dimension may be defined by continuous structure of the base, by converging structure of the base, by ribs or similar structure, or by any other structure that defines the clearance dimension.

The present disclosure also includes a method of releasably securing the handle 12 to the elongate member 14. The method may include the disclosure described above and may, for example, include the steps of: inserting the enlarged element 44 (or 46 or 120) associated with the elongate member into the first passage 52 defined by the base 34 of the handle extending through the base, the first passage sized to permit the passage therethrough of the enlarged element and the elongate member; sliding or otherwise moving the elongate member along the channel 70 defined by the base of the handle extending through the base from the first passage to the second passage defined by the base of the handle extending through the base, the channel interconnecting the first passage and the second passage, the channel sized to permit passage of the elongate member through the channel and to prevent passage of the enlarged element through the channel, the second passage sized to permit the passage therethrough of the elongate member and to prevent the passage therethrough of the enlarged element; and pulling the elongate member such that the enlarged element is received by the second passage and engaged with a ledge of the base defining the second passage.

Any of the embodiments described herein may be modified to include any of the structures or methodologies disclosed in connection with other embodiments.

Numerous modifications to the present disclosure will be apparent to those skilled in the art in view of the foregoing description. Accordingly, this description is to be construed as illustrative only and is presented for the purpose of enabling those skilled in the art to make and use the embodiments of the disclosure and to teach the best mode of carrying out same. The exclusive rights to all modifications which come within the scope of the appended claims are reserved.

The invention claimed is:

1. An exercise device comprising:

an elongate member;

a connector engaged with the elongate member;

an enlarged element;

a webbing interconnecting the enlarged element and the connector such that the webbing is disposed between the enlarged element and the connector, the webbing being engaged with the connector at two locations on the connector; and a handle comprising a yoke and a handgrip, the yoke including a pair of opposed surfaces and a base defining at least one passage extending from one of the opposed surfaces of the yoke to the other of the opposed surfaces of the yoke sized to receive the webbing and to prevent the passage therethrough of the enlarged element to releasably secure the handle to the elongate member;

wherein the enlarged element includes a gripping portion with opposing curved surfaces configured to be grasped by a user for pulling the elongate member relative to the yoke such that the webbing extends through the passage and the elongate member and the enlarged element are disposed on opposite sides of said one of the opposed surfaces of the yoke and the connector is spaced from the elongate member .

2. The exercise device of claim 1 wherein the elongate member comprises multiple elastic tubes that are braided together.

3. The exercise device of claim 2 wherein each of the elastic tubes has an enlarged end for engaging the connector.

4. The exercise device of claim 3 wherein the connector defines a plurality of holes, each hole receiving a respective one of the braided tubes.

5. The exercise device of claim 4 wherein each hole is sized to prevent passage therethrough of a respective enlarged end.

6. The exercise device of claim 1 further including a sheath disposed over the webbing extending between the connector and the enlarged element, wherein said passage is sized to receive the sheath and the webbing.

7. The exercise device of claim 1 wherein the enlarged element includes a plug portion configured to be received by said passage and to engage the base defining said passage to releasably secure the enlarged element to the yoke.

8. The exercise device of claim 1 wherein the enlarged element includes a plug portion configured to be received by said passage and to engage the base defining said passage to releasably secure the enlarged element to the yoke.

9. The exercise device of claim 1 wherein the yoke further defines another passage extending through the base and a channel extending through the base interconnecting the passages, said other passage sized to permit the passage therethrough of the webbing and the enlarged element to selectively engage and disengage the elongate member and the handle, the channel sized to permit movement of the webbing from said other passage to said passage to releasably secure the enlarged element to the yoke.

10. The exercise device of claim 1 wherein the elongate member comprises an elastic tube.

11. The exercise device of claim 1 wherein each of the opposing surfaces includes a plurality of gripping ribs for gripping by a user to facilitate moving the elongate member.

12. The exercise device of claim 1 wherein the opposing surfaces form oppositely-facing indentation to be grasped by the user.

13. The exercise device of claim 1 wherein the gripping portion includes gripping ribs for gripping by a user to facilitate moving the elongate member.

* * * * *